US006215236B1

(12) United States Patent
Gotoh et al.

(10) Patent No.: US 6,215,236 B1
(45) Date of Patent: Apr. 10, 2001

(54) HALOGEN LAMP HAVING THICK WALL PINCH SEAL PORTION

(75) Inventors: Hiroshi Gotoh; Masayuki Umehara, both of Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/187,413

(22) Filed: Nov. 6, 1998

(30) Foreign Application Priority Data

Nov. 7, 1997 (JP) ..... 9-305216

(51) Int. Cl.[7] ..... H01J 5/48; H01J 5/50

(52) U.S. Cl. ..... 313/318.07; 313/318.01; 313/318.09; 313/318.1

(58) Field of Search ..... 313/318.01, 318.07, 313/318.09, 318.1, 634; 362/306, 288, 368, 369, 370; 439/220, 223, 222

(56) References Cited

U.S. PATENT DOCUMENTS 4,139,794 * 2/1979 Malm et al. ..... 313/220
4,883,434 * 11/1989 Toyoshima ..... 439/619
5,339,002 * 8/1994 Braun et al. ..... 313/318
5,818,154 * 10/1998 Helbig et al. ..... 313/318.01
5,994,825 * 11/1999 Goto et al. ..... 313/318.07

* cited by examiner

*Primary Examiner*—Nimeshkumar D. Patel
*Assistant Examiner*—Karabi Guharay
(74) *Attorney, Agent, or Firm*—Sughrue, Mion, Zinn, Macpeak & Seas, PLLC

(57) ABSTRACT

Disclosed is a lamp having a lamp capsule consisting of a glass bulb containing filaments sealed therein with a substantially flat pinch-sealed portion being formed integrally at one end of the glass bulb, and being held at the pinch-sealed portion by a retaining plate; the lamp comprising a plurality of holding pieces for chucking the pinch-sealed portion, formed on the retaining plate; and thick-wall portions formed at that end of the pinch-sealed portion which constitutes the boundary with the glass bulb, except for the crosswise middle part of the pinch-sealed portion, so that the thick-wall portions may be brought into contact with the holding pieces.

8 Claims, 5 Drawing Sheets

HALOGEN LAMP HAVING THICK WALL PINCH SEAL PORTION

BACKGROUND OF THE INVENTION

The present invention relates generally to a lamp in which a lamp capsule and a retaining plate are connected with each other by allowing the retaining plate to chuck the lamp at the pinch-sealed portion, particularly to a technique of preventing breakage and backlash of the lamp capsule.

DESCRIPTION OF THE RELATED ART

Lamps, for example, H4 type halogen lamps which are employed most widely, are each of the structure, in which the lamp capsule thereof has a glass bulb which is closed at one end with a pinch-sealed portion and at the other end with an evacuating portion, and filaments are extended respectively across suitable ones of a plurality of leads penetrating the pinch-sealed portion and being retained by that portion.

FIG. 5 shows schematically an example of the lamp capsule a of the conventional halogen lamp as described above. In the lamp capsule a, a substantially flat pinch-sealed portion b has on each crosswise side face a pair of ridges c (only one ridge is shown), and a pair of engaging protrusions d formed substantially at the center of each side face. The lamp capsule a is chucked at the pinch-sealed portion b by a metal retaining plate e which is to be set in a base not shown.

Two pairs of opposing intermediate holding pieces f (only one pair is shown) and two pairs of opposing side holding pieces g (only one pair is shown) are formed on the retaining plate e.

Thus, when the lamp capsule a is inserted at the pinch-sealed portion b down into the retaining plate e, the portion b is chucked between the two pairs of opposing intermediate holding pieces f and between the two pairs of side holding pieces g. In this instance, the intermediate holding pieces f are brought into resilient contact with the respective side faces at the middle part of the pinch-sealed portion b and are also engaged with the upper faces of the engaging protrusions d formed on the side faces of the pinch-sealed portion b, while the side holding pieces g are brought into resilient contact with the respective side faces at the middle part of the pinch-sealed portion b and are also engaged with that end i of the glass bulb h of the lamp capsule a which is located on the pinch-sealed portion side. The engagements achieved by these holding pieces prevent the lamp capsule a from slipping off from the retaining plate e.

However, in such a lamp as described above, poor processing accuracy in the lamp capsule a, particularly at the pinch-sealed portion b, forms gaps between the end i of the glass bulb h and the tips of the respective side holding pieces g of the retaining plate e holding the lamp capsule a to cause backlash of the lamp capsule a with respect to the retaining plate e, disadvantageously.

Such backlash of the lamp capsule a causes displacement of the filaments whose positions should strictly be restricted to disturb the light distribution pattern of lighting fixtures.

The lamp capsule a involves a problem due to its structure in which the tip of each sharp-edged side holding piece g of the retaining plate e is brought into contact with the end i of the glass bulb h to cause damages so-called kinking or cracking in the glass bulb h and the pinch-sealed portion b, resulting in the occurrence of many defectives in the process of producing lamp capsules a.

SUMMARY OF THE INVENTION

In view of the problems described above, the lamp according to the present invention is directed to prevent breakage and backlash of lamp capsules.

In the lamp according to the present invention, with a view to solving the problems described above, a plurality of holding pieces are formed on a retaining plate so as to chuck the lamp capsule at the pinch-sealed portion, and thick-wall portions are formed on the glass bulb-side end of the pinch-sealed portion except for the widthwise central part, so that the thick-wall portions may be brought into contact with the holding pieces.

Accordingly, backlash of the lamp capsule can be prevented by the thick-wall portions, and since the thick-wall portions are formed except for the widthwise central part of the pinch-sealed portion by urging the glass at the central part toward the thick-wall portions when the pinch-sealed portion is molded, the thick-wall portions can be molded in a stable form.

Other aspects and advantages of the invention will become apparent from the following description, taken in conjunction with the accompanying drawings illustrated by way of examples the principles of the invention.

BRIEF DESCRIPTION OF THE DRAWINGS

The invention together with the objects and advantages thereof, may best be understood by reference to the following description of the presently preferred embodiments together with the accompanying drawings in which.

DETAILED DESCRIPTION OF THE PREFERRED EMBODIMENTS

Figure 1:
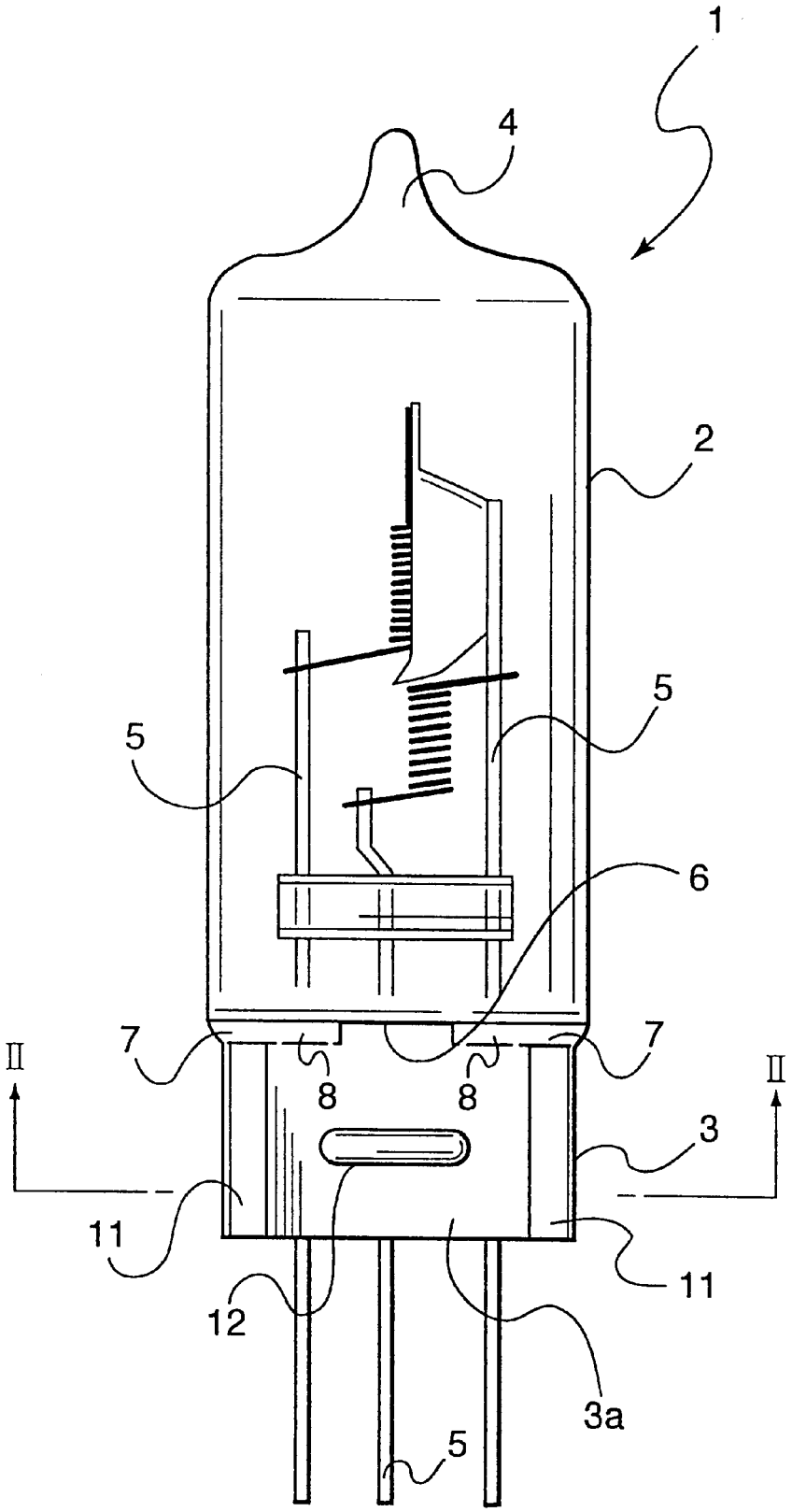
FIG. 1, showing together with FIGS. 2 to 4 a lamp according to an embodiment of the present invention, is a side view of a lamp capsule.

The mode for carrying out the present invention will be described below in terms of a so-called H4 halogen lamp referring to the attached drawings.

A lamp capsule 1 of the halogen lamp consists of a glass bulb 2 and a pinch-sealed portion 3. The glass bulb 2 is closed at one end with the pinch-sealed portion 3 and at the other end with an evacuating portion 4 to be hermetically sealed. The lamp capsule 1 contains leads 5 each penetrating the pinch-sealed portion 3 and being retained at the middle part thereby.

Figure 2:
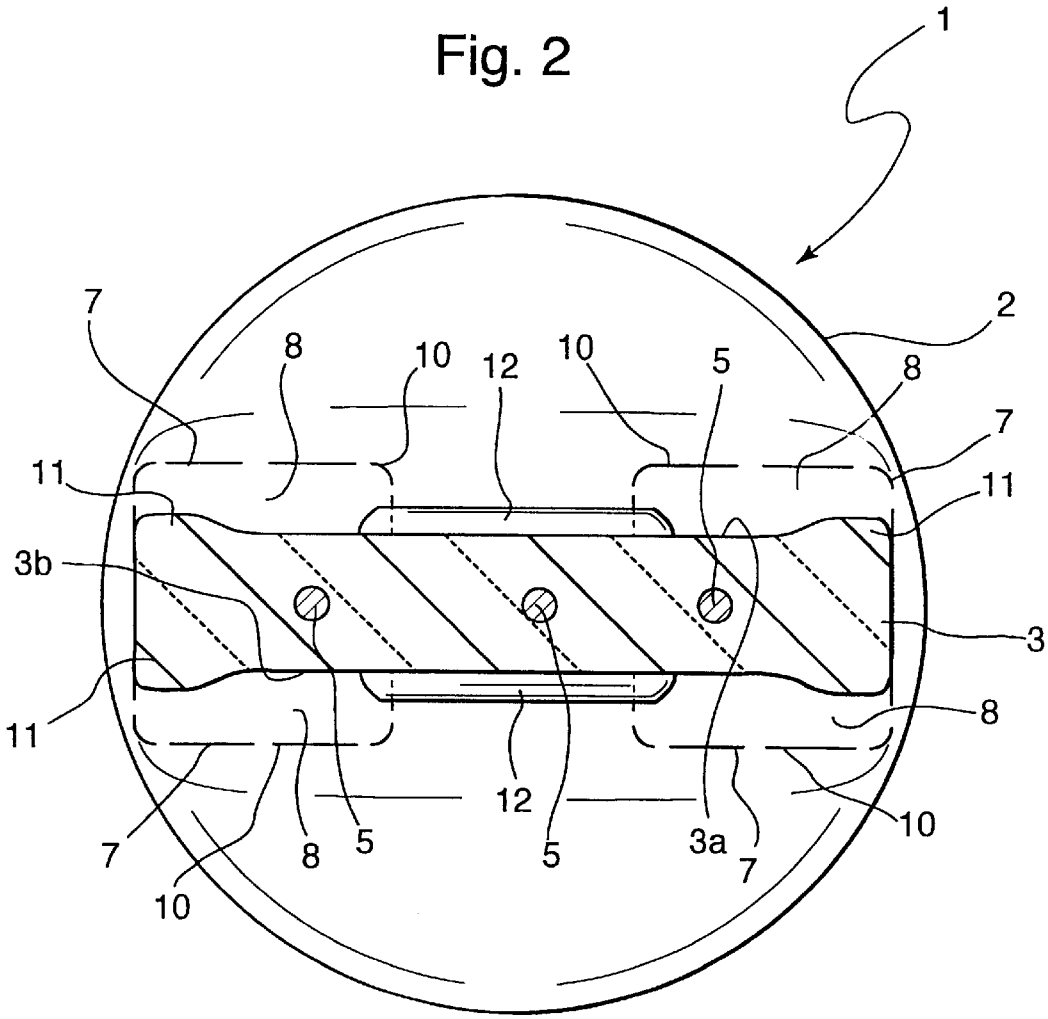
FIG. 2 is a cross-sectional view taken along the line II—II of FIG. 1.
Figure 4:
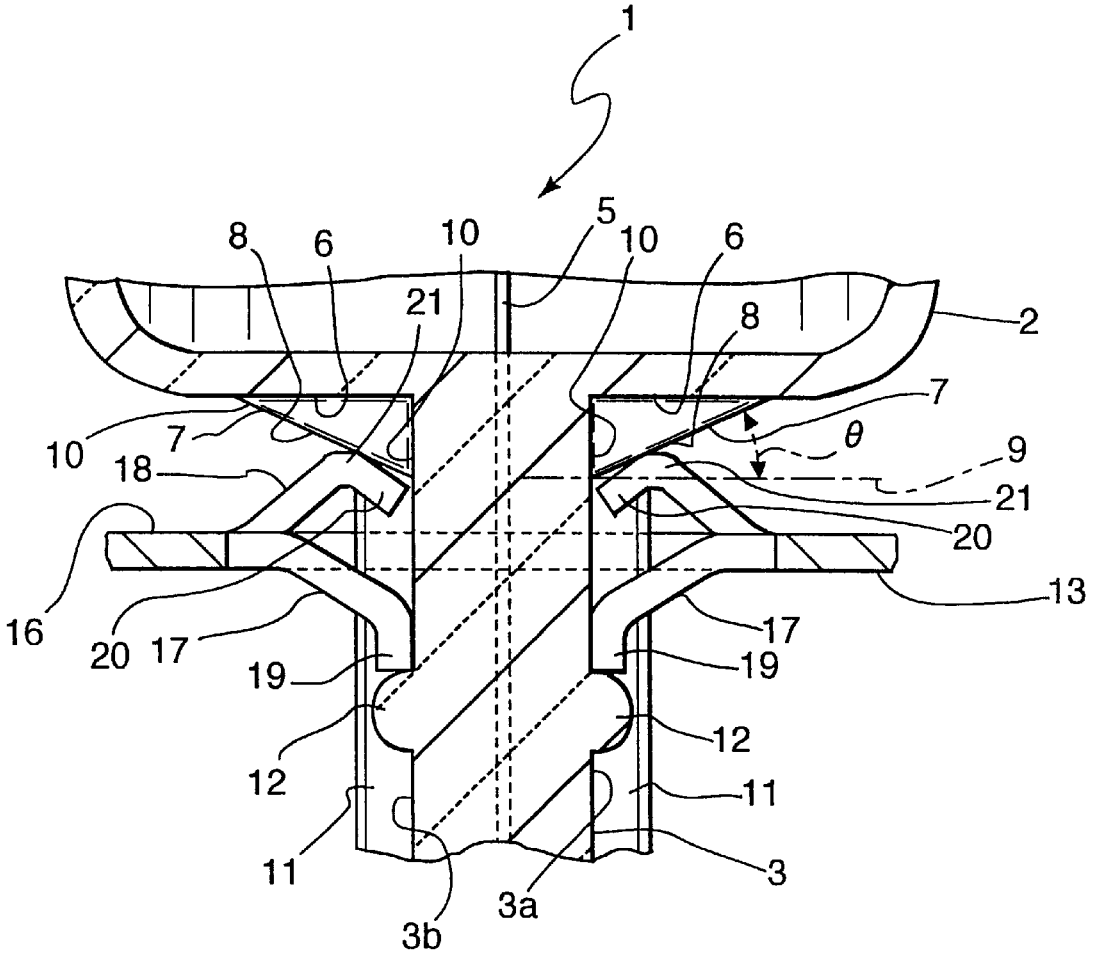
FIG. 4 is an enlarged vertical cross-sectional view of the major section showing how the lamp capsule is connected to the retaining plate.
Figure 5:
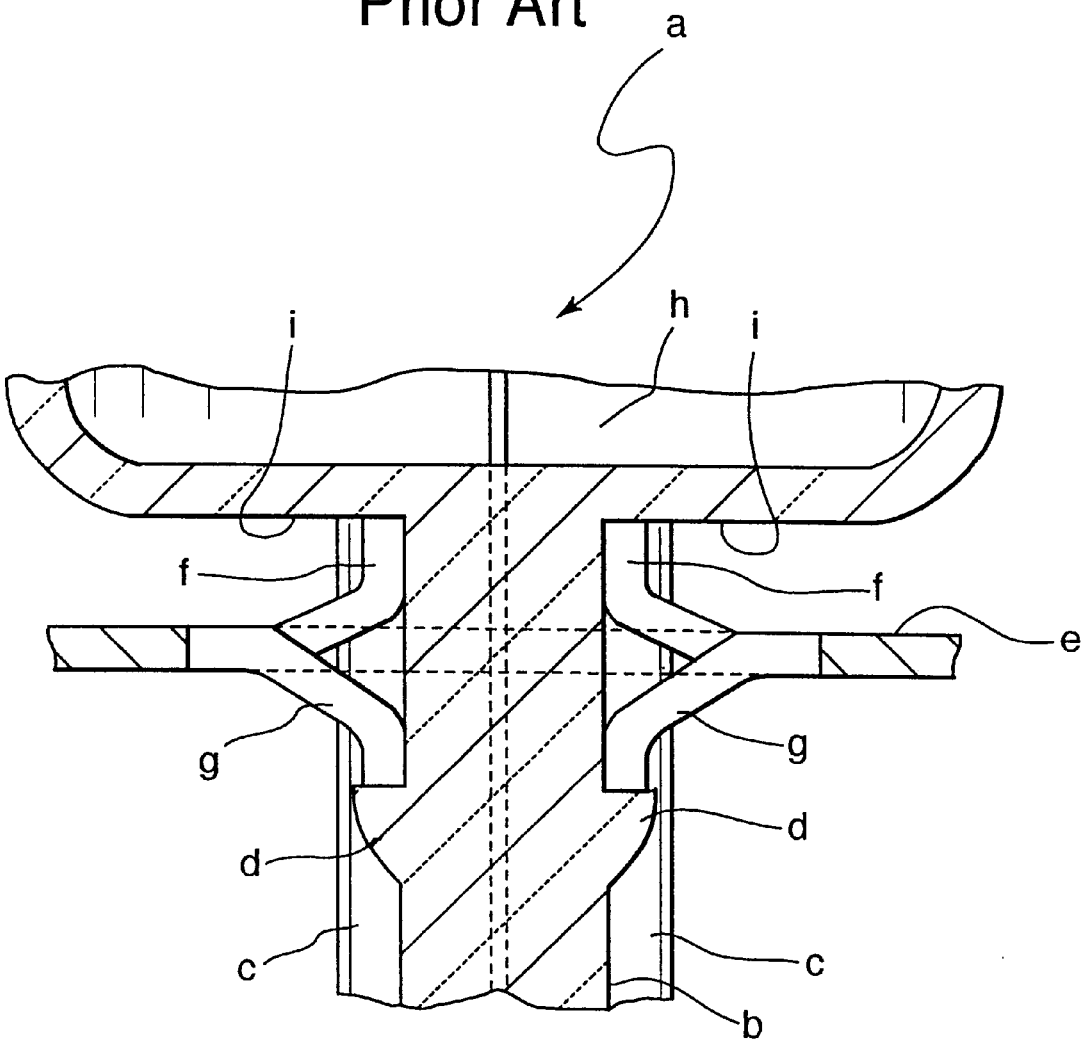
Fig. 5 Prior Art
FIG. 5 is an enlarged vertical cross-sectional view showing how the lamp capsule is connected to the retaining plate in the conventional lamp.

At the end 6 of the pinch-sealed portion 3 constituting the boundary with the glass bulb 2, thick-wall portions 7 thicker than the other portions of the glass bulb 2 are formed at a position close to the proximal end of the pinch-sealed portion 3, except for the widthwise central part of the pinch-sealed portion 3, as shown in FIGS. 1, 2 and 4.

The thick-wall portions 7 are formed to protrude outward (downward) from the glass bulb 2, and the lower faces 8 thereof are designed to form a predetermined angle θ with respect to the plane 9 orthogonal to the pinch-sealed portion 3. Here, the angle θ is preferably 45° or less, most suitably between 20° and 30° (24.5° in the embodiment of the present invention). Meanwhile, the length of the thick-wall portions 7 along the width of the pinch-sealed portion 3 is designed to be about twice as long as the width of pinch-sealed portion-side holding pieces of a retaining plate to be described later. The borders 10 between the faces constituting each thick-wall portion 7 and those between the faces constituting each thick-wall portion and the faces constituting the pinch-sealed portion 3 are of gently curved, so that the borders 10 between these faces are prevented from being angled to form sharp edges.

The reason why the angle θ is specified within the range of 20 to 30° is as follows. If the angle θ is more than 45°, holding pieces of the retaining plate to be described later slip upward when the lamp capsule is set thereon, disadvantageously; whereas when the angle θ is ≈0, it can happen that the lamp capsule 1 cannot be chucked by the holding pieces of the retaining plate if there is any variation in the dimensions of the holding pieces.

Further, the reason why a pair of thick-wall portions 7 are formed on each surface of the pinch-sealed portion 3 except for the widthwise central part thereof, as described above, is as follows. When the pinch-sealed portion 3 is formed by pinching a cylindrical glass tube at one end portion with pincers, the central part of the glass in the portion constituting the end 6 of the pinch-sealed portion 3 is urged outside when it is molded to make up for the lack of glass in forming the thick-wall portions 7 to ensure formation of the configuration thereof.

Further, the reason why the borders 10 between the faces constituting each thick-wall portion 7, and those between the faces constituting each thick-wall portion 7 and the faces constituting the pinch-sealed-portion 3 are gently curved so as to prevent these faces from forming angles to have sharp edges is to release the stress, if concentrated to such portions, applied when the lamp capsule 1 is chucked by the holding pieces of the retaining plate and thus to prevent cracking and the like from occurring.

The pinch-sealed portion 3 has a substantially flat shape and a pair of ridges 11 are formed on each crosswise side 3*a* (3*b*) thereof at the widthwise end portions. Engaging protrusions 12 are formed substantially on the side faces 3*a* and 3*b* at the middle parts to extend along the width thereof, respectively, and a suitable clearance is defined between each engaging protrusion and each ridge 11.

Figure 3:
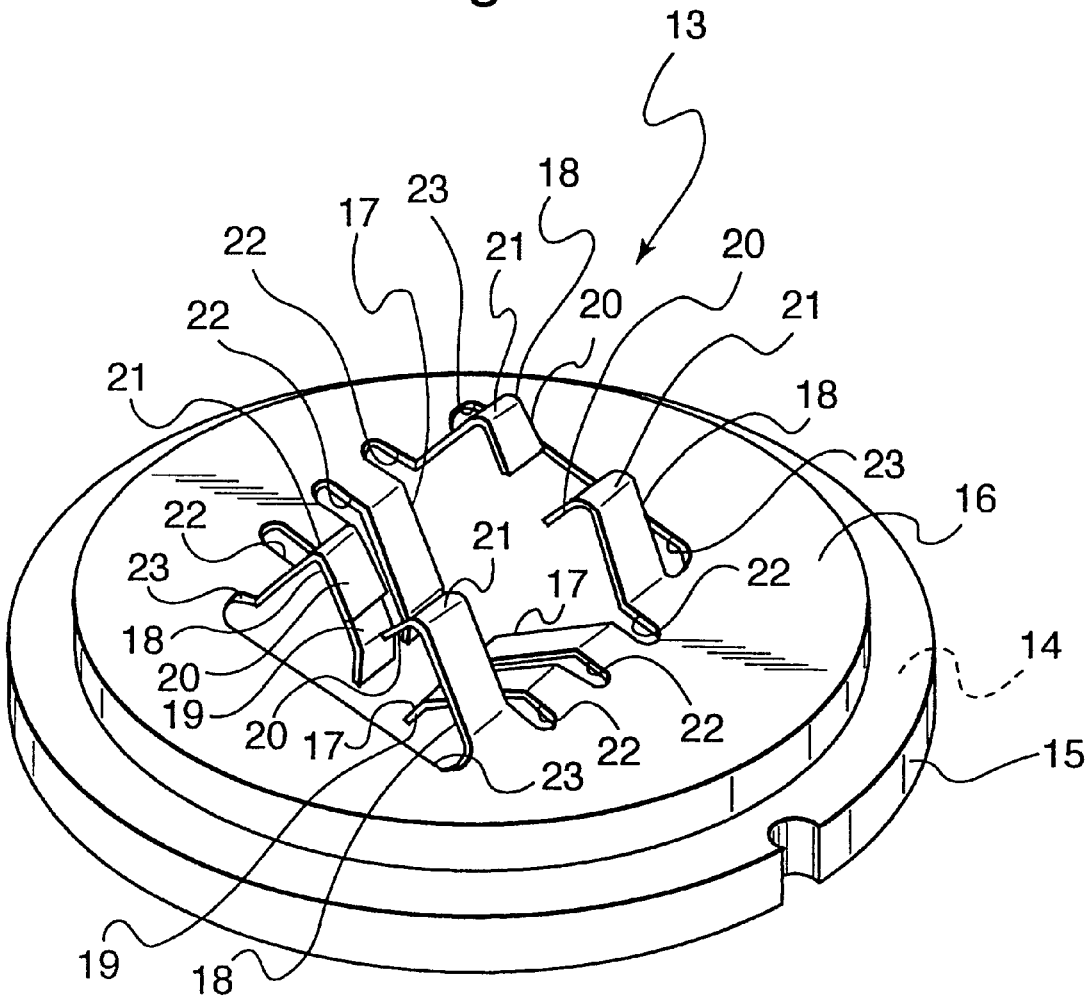
FIG. 3 is a perspective view of the retaining plate.

The retaining plate 13, which is formed by molding a metal plate having spring elasticity, is substantially round in plan view, as shown in FIG. 3. The periphery of the retaining plate 13 is bent stepwise to form an abutting face 14 facing downward and a caulking edge 15 extended to be bent down from the periphery of the abutting face 14. The retaining plate 13 having such a constitution is fitted on a cylindrical metal part (not shown) and is fixed thereto by caulking the caulking edge 15 to constitute a base.

Two pairs of inner pinch-sealed portion-side holding pieces 17 and two pairs of outer glass bulb-side holding pieces 18 are formed on the retaining face 16 of the retaining plate 13 by slitting the retaining face 16 and bending the finger-like pieces thus formed.

Each pair of pinch-sealed portion-side holding pieces 17 are formed to oppose each other, as shown in FIGS. 3 and 4, and they are bent diagonally downward from the retaining face 16 to form together a V-like shape in side view, and the tip 19 of each holding piece 17 is further bent downward.

Each pair of glass bulb-side holding pieces 18 are also formed to oppose each other and are bent diagonally upward from the retaining face 16 to form together an inverted V-like shape, and the holding pieces 18 are bent at the tips 20 diagonally downward and form inverted V shapes to constitute bent portions 21 respectively. The clearance between the tips of each pair of glass bulb-side holding pieces 18 is designed to be slightly wider than the thickness of the pinch-sealed portion 3 where no ridge is formed.

These two kinds of holding pieces 17 and 18 each have slits 22 at the proximal end so as to increase the elasticity of these holding pieces 17 and 18, as shown in FIG. 3. Further, notches 23 are formed on the outer sides of the glass bulb-side holding pieces 18 respectively so that the profile in plan view of the opening defined in the retaining face 16 by forming the notches 23 and the holding pieces 17 and 18 may correspond to the cross section of the pinch-sealed portion 3 of the lamp capsule 1 shown in FIG. 2.

Thus, the lamp capsule 1 is inserted at the pinch-sealed portion 3 into the clearance defined between each pair of holding pieces 17 and each pair of holding pieces 18 of the retaining plate 13 such that the bent portions 21 of the glass bulb-side holding pieces 18 may be abutted against the lower faces 8 of the thick-wall portions 7, respectively, and that the tips 19 of the pinch-sealed portion-side holding pieces 17 may be abutted against the upper faces of the engaging protrusions 12, respectively, as shown in FIG. 4.

That is, when the pinch-sealed portion 3 is inserted to the opening of the retaining face 16 of the retaining plate 13, the glass bulb-side holding pieces 18 pass through the gaps present between the engaging protrusions 12 and the ridges 11 to reach the pinch-sealed end 6 of the glass bulb 2; whereas the pinch-sealed portion-side holding pieces 17 ride once at the tips 19 onto the engaging protrusions 12 to ride over them and are engaged with the upper faces of the engaging protrusions 12. In this state, the pinch-sealed portion-side holding pieces 17 are adapted to be brought into resilient contact with the respective sides 3*a* and 3*b* of the middle part of the pinch-sealed portion 3 under the retaining face 16 to chuck it.

Further, the tips 19 of the pinch-sealed portion-side holding pieces 17 are engaged with the upper faces of the engaging protrusions 12, while the bent portions 21 of the glass bulb-side holding pieces 18 are brought into resilient contact at the outer portions with the lower faces 8 of the thick-wall portions 7. Thus, the lamp capsule 1 is prevented from slipping off from the retaining plate 13 due to the resilient contact of these holding pieces 17 and 18 with the pinch-sealed portion 3.

Since the lamp bulb 1 is engaged with the glass bulb-side holding pieces 18 at the thick-wall portions 7 formed at the glass bulb-side end 6 of the pinch-sealed portion 3, the thick-wall portions 7 can withstand the stress if concentrated thereto under engagement with the glass bulb-side holding pieces 18. Further, since the glass bulb-side holding pieces 18 are engaged with the thick-wall portions 7 not at the tips 20 but at the bent portions 21, enabling prevention of damage which can occur when the sharp-edged portions of the holding pieces are engaged with the glass bulb 2.

Further, since the lower faces 8 of the thick-wall portions 7 are designed to form an angle of 45° or less (specifically 20 to 30°) with respect to the plane 9 orthogonal to the pinch-sealed portion 3, accuracy of contact between them can be improved without being affected by the variation in the machining accuracy of the holding pieces 18 to enable effective prevention of backlash of the lamp capsule.

Furthermore, since the clearance between the tips 20 of each pair of opposing glass bulb-side holding pieces 18 are designed to be slightly wider than the thickness of the pinch-sealed portion 3, the tips 20 do not interfere with the pinch-sealed portion 3, thus preventing the pinch-sealed portion 3 from being damaged by the sharp edges of the holding pieces 18.

As is clear from the above description, in the lamp according to the present invention, since a plurality of holding pieces for chucking the pinch-sealed portion are formed on the retaining plate, and since thick-wall portions are formed at the glass bulb-side end of the pinch-sealed portion, except for the crosswise middle part of the pinch-sealed portion to bring the thick-wall portions into contact with the holding pieces, backlash of the lamp capsule can be prevented by the thick-wall portions, whereas since the thick-wall portions are formed except for the widthwise central part of the pinch-sealed portion by urging the glass at the central part toward the thick-wall portions when the pinch-sealed portion is molded, the thick-wall portions can be molded in a stable form.

Meanwhile, in the invention set forth in the appended claim 2, the dimension of the thick-wall portions in the direction of the width of the pinch-sealed portion is designed to be about twice as wide as the width of the holding pieces of the retaining plate, so that the holding pieces can securely be brought into contact with the thick-wall portions.

Further, in the invention set forth in the appended claim 3, since the faces of the thick-wall portions to be abutted against the holding pieces of the retaining plate are designed to form an angle of 45° or less with respect to the plane orthogonal to the side faces of the pinch-sealed portion, variation in the configuration of the holding pieces of the retaining plate can be absorbed by these angled faces to allow the pinch-sealed portion to be chucked securely by the holding pieces without backlash.

Incidentally, the configurations and structures of the respective parts shown typically in the above embodiment are to be considered as merely illustrative in carrying out the present invention, and the technical scope of the present invention is not to be limited to the details given herein, but my be modified within the scope of the appended claims.

What is claimed is:

1. A lamp having a lamp capsule consisting of a glass bulb containing filaments sealed therein with a substantially flat pinch-sealed portion being formed integrally at one end of the glass bulb, and being held at the pinch-sealed portion by a retaining plate; the lamp comprising:

a plurality of holding pieces for chucking the pinch-sealed portion formed on the retaining plate; and thick-wall portions formed at that end of the pinch-sealed portion which constitutes the boundary with the glass bulb, except for the crosswise middle part of the pinch-sealed portion, so that the thick-wall portions may be brought into contact with the holding pieces.

2. The lamp according to claim 1, wherein the dimension of the thick-wall portions in the direction of the width of the pinch-sealed portion is about twice as wide as the width of the holding pieces of the retaining plate.

3. The lamp according to claim 2, wherein the faces of the thick-wall portions to be abutted against the holding pieces of the retaining plate are designed to form an angle of 45° or less with respect to the plane orthogonal to the side faces of the pinch-sealed portion.

4. The lamp according to claim 3, wherein the faces of the thick-wall portions to be abutted against the holding pieces of the retaining plate are designed to form an angle of 20° to 30° or less with respect to the plane orthogonal to the side faces of the pinch-sealed portion.

5. The lamp according to claim 1, wherein the faces of the thick-wall portions to be abutted against the holding pieces of the retaining plate are designed to form an angle of 45° or less with the respect to the plane orthogonal to the side faces of the pinch-sealed portion.

6. The lamp according to claim 5, wherein the faces of the thick-wall portions to be abutted against the holding pieces of the retaining plate are designed to form an angle of 20° to 30° or less with respect to the plane orthogonal to the side faces of the pinch-sealed portion.

7. The lamp according to claim 1, wherein the faces of the thick-wall portions to be abutted against the holding pieces of the retaining plate form an angle of 20–45° with respect to the plane orthogonal to the side faces of the pinch-sealed portion.

8. The lamp according to claim 7, wherein the faces of the thick-wall portions to be abutted against the holding pieces of the retaining plate form an angle of 20–30° with respect to the plane orthogonal to the side faces of the pinch-sealed portion.

* * * * *